US005611157A

United States Patent [19]

Ferreira

[11] Patent Number: 5,611,157

[45] Date of Patent: Mar. 18, 1997

[54] WEAR PAD ASSEMBLY

[75] Inventor: Thomas Ferreira, Fairhaven, Mass.

[73] Assignee: F & B Enterprises, Inc., New Bedford, Mass.

[21] Appl. No.: 530,836

[22] Filed: Sep. 20, 1995

Related U.S. Application Data

[63] Continuation-in-part of Ser. No. 132,135, Oct. 5, 1993, Pat. No. 5,471,770.

[51] Int. Cl.[6] ..... E02F 9/28

[52] U.S. Cl. ..... 37/449; 37/264; 37/266; 172/701.1

[58] Field of Search ..... 37/264, 266, 233, 37/232, 446, 449, 460; 172/719, 772, 701.1; 15/245; 267/141.1

[56] References Cited

U.S. PATENT DOCUMENTS

| | | | |
|---|---|---|---|
| 634,578 | 10/1899 | Kaucher | 37/117.5 |
| 2,061,585 | 11/1936 | Meyer . | |
| 2,285,039 | 6/1942 | Lowe | 172/719 X |
| 2,350,437 | 6/1944 | Wiedman | 15/245 X |
| 2,778,129 | 1/1957 | Fryer . | |
| 3,126,652 | 3/1964 | Reissinger | 15/245 |
| 3,465,456 | 9/1969 | Meyer | 15/245 X |
| 3,466,766 | 9/1969 | Kahlbacher | 15/245 X |
| 3,477,149 | 11/1969 | Wagner | 15/245 |
| 3,772,803 | 11/1973 | Cote . | |
| 3,934,654 | 1/1976 | Stephenson et al. . | |
| 4,141,160 | 2/1979 | Olson . | |
| 4,347,677 | 9/1982 | Küper . | |
| 4,570,366 | 2/1986 | Yost . | |
| 4,590,694 | 5/1986 | Block | 172/719 X |
| 4,819,349 | 4/1989 | Mensch . | |
| 4,995,598 | 2/1991 | Ingham . | |
| 5,012,599 | 5/1991 | DeClair et al. . | |
| 5,075,985 | 12/1991 | Mensch . | |
| 5,140,763 | 8/1992 | Nichols, IV . | |
| 5,144,713 | 9/1992 | Unger | 15/245 |
| 5,207,010 | 5/1993 | Grossman . | |
| 5,210,965 | 5/1993 | Funk, Sr. et al. | 172/719 X |
| 5,224,555 | 7/1993 | Bain et al. | 172/719 X |
| 5,351,844 | 10/1994 | Carlstedt . | |
| 5,412,885 | 5/1995 | Cornelius | 172/719 X |
| 5,471,770 | 12/1995 | Ferreira | 37/264 |

*Primary Examiner*—Terry Lee Melius
*Assistant Examiner*—Victor Batson
*Attorney, Agent, or Firm*—Wolf, Greenfield & Sacks, P.C.

[57] ABSTRACT

A wear pad for use with large machines used to pick up or push material from a flat surface, in which a wear pad is secured to the lip of the apparatus that pushes the material. The pad includes a plurality of similar abradable sections sandwiched together under compression with a pair of parallel edges, either of which may be positioned to function as the lead edge of the wear pad.

20 Claims, 6 Drawing Sheets

WEAR PAD ASSEMBLY

PRIOR APPLICATIONS

This application is a continuation in part of application Ser. No. 08/132,135, filed Oct. 5, 1993, which is now U.S. Pat. No. 5,471,770.

FIELD OF THE INVENTION

This invention relates to a large machine-operated device, such as a bucket on a front end loader, which picks up or pushes objects or material from a surface.

BACKGROUND OF THE INVENTION

Front end loaders or other large machine-operated equipment carrying a bucket, scoop, or plow are used to move objects or material from ground surfaces. When using a bucket, which is typically made of metal, significant damage can be caused not only to the bucket but also, more importantly, to the ground surface, such as a concrete floor or an outdoor street over which it is scooped. Such damaged concrete floors and streets can be very expensive to replace or repair. Some users couple a metal piece to the bottom of the bucket. This piece protects the bucket, but the wear to the ground surface is still significant.

At some airports, a single molded rubber strip has been attached to the bottom of a plow for plowing runways. A typical strip is of about six inches high and about one inch thick of molded rubber is secured the depth of the bucket. This molded strip wears quickly. Since it has a greater height than thickness, it folds under the plow when used. A similarly shaped strip of plastic has also been tried. These devices are very difficult to install and maintain. Moreover, replacing these wear strips is expensive and timeconsuming. Furthermore, an elongated strip that is worn only in selected areas must be replaced in its entirety. An elongated strip that becomes partially loose can, furthermore, create problems in plowing and in maintenance of the unit.

SUMMARY OF THE INVENTION

According to the present invention, a wear pad assembly is coupled to a bottom portion of a device, such as a bucket or plow, which is used to pick up or push material over a concrete floor. The assembly is formed of a series of wear pads, each of which has a plurality of sections which are sandwiched together along an axis transverse to the direction that the device is operated. The plurality of sections of each wear pad has about the same general cross-section. For each wear pad, a steel top plate extends along a top surface of each section. The top surface may be planar, or may have a recessed portion sized to receive the top plate. Two end plates, each with two apertures, are welded perpendicular to the top plate. Dividers extending from the plate may be provided periodically between a number of sections. A pair of rods, which are parallel to each other and to the top plate, preferably extend through each of the sections and through the apertures in the end plates.

The front surface of the sections may be inclined so that the front surface forms an acute angle relative to the bottom surface. This shape assists scooping or pushing material from the ground surface.

Preferably two to six wear pads or more are coupled to a bucket so that these extend along the width of the bucket. Since the sections are compressed near the top of each section, the assembly has a generally planar bottom surface since the sections flare at the bottom, although there may still be some small gap between adjacent wear pads.

According to another embodiment of the present invention, the front surface of the wear pad can be inclined so that it forms an obtuse angle relative to the bottom surface. This shape may be employed for picking up certain types of sturdy material when an operator wants the metal bucket to first strike the material, rather than having the wear pad strike the material.

For each section, the thickness across the front surface facing the direction of operation is smaller than the width of the section.

Preferably, the sections are made from a fabric reinforced rubber, such as pieces of rubber tires. Some or all sections may include molded rubber or a polymer such as a polyurethane or polypropylene. One molded section of rubber or polyurethane may be used for every given number of reinforced rubber sections.

The wear pad assembly according to the present invention reduces wear on a concrete floor or street while improving the ability to pick up or push material. The front surface of the wear pad can act as a squeegee in the acute angle embodiment, thus improving pick up and removal of material. The wear pad assembly also reduces shock and vibration from the bucket striking the ground, and thus makes operation of the device more comfortable for the operator. Because of the compression transverse to the direction of operation, the wear pad is held rigidly relative to the bottom portion and does not fold under the device.

In the modification of this invention the wear pad assembly, made in general as herein described, is further modified to include a reversible wear pad. In this modification, the life of the wear pad may be effectively lengthened by providing a pad having a pair of edges, either of which may function as a lead edge. This wear pad assembly is also formed of a plurality of sections compressed together to define an overall shape, in which the pad is essentially symmetrical in cross sectional configuration with a pair of parallel edges each defined by a common lower surface and a pair of acute surfaces extending therefrom.

In a further modification of this invention, the wear pad assembly is formed of a plurality of like molded wear pads that are individually secured to a common support which, in turn, is secured to the bottom portion of the bucket or the like. These individual wear pads are arranged in a longitudinal parallel array and are molded in a manner which permits the individual wear pads to be bolted to the common support so that individual wear pads may be selectively replaced.

BRIEF DESCRIPTION OF THE DRAWINGS

Other features and advantages will become apparent from the following detailed description and from the drawings in which.

Figure 2:
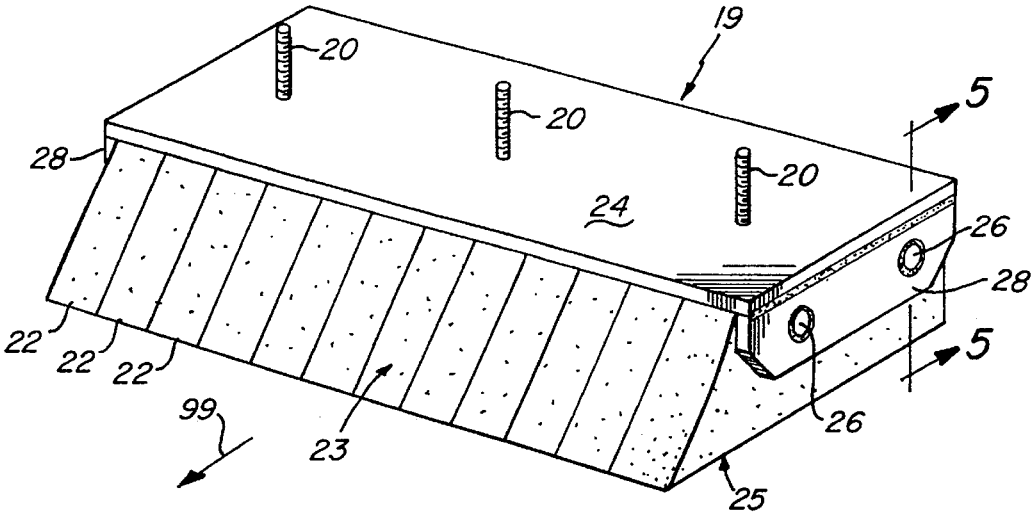
FIG. 2 is a perspective view of the wear pad shown in FIG. 1.
Figure 3:
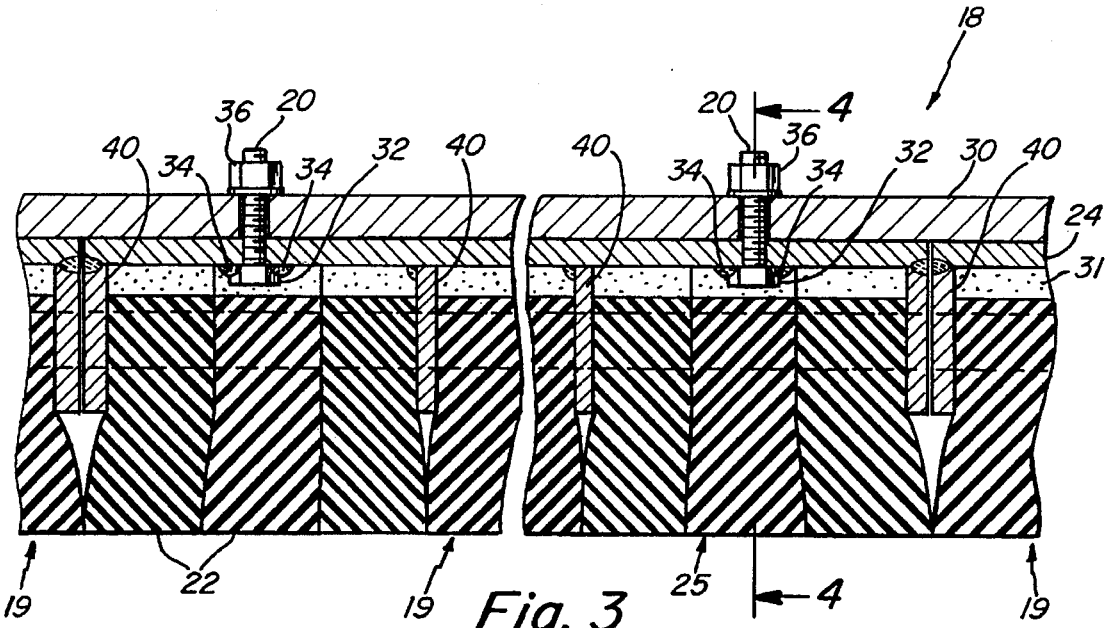
FIG. 3 is a cross-section taken along the line 3—3 in FIG. 1.
Figure 5:
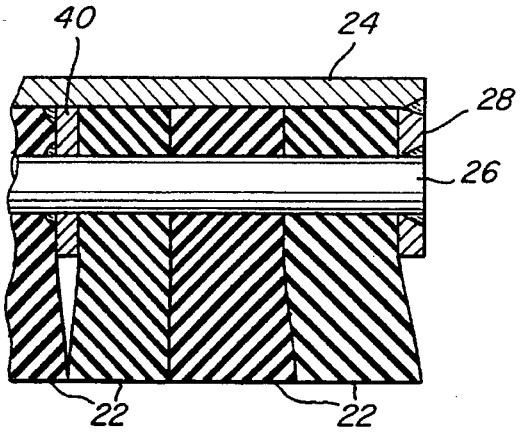
Figure 6:
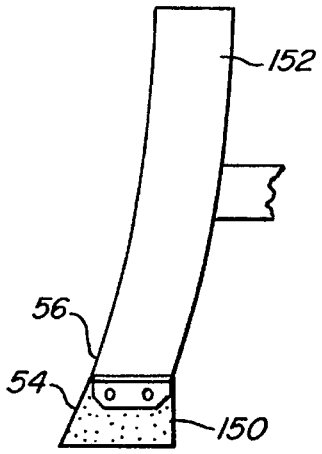
Figure 7:
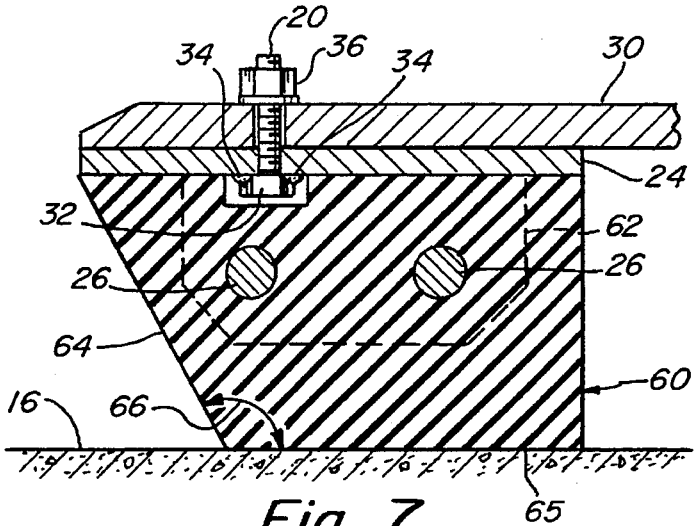
Figure 8:
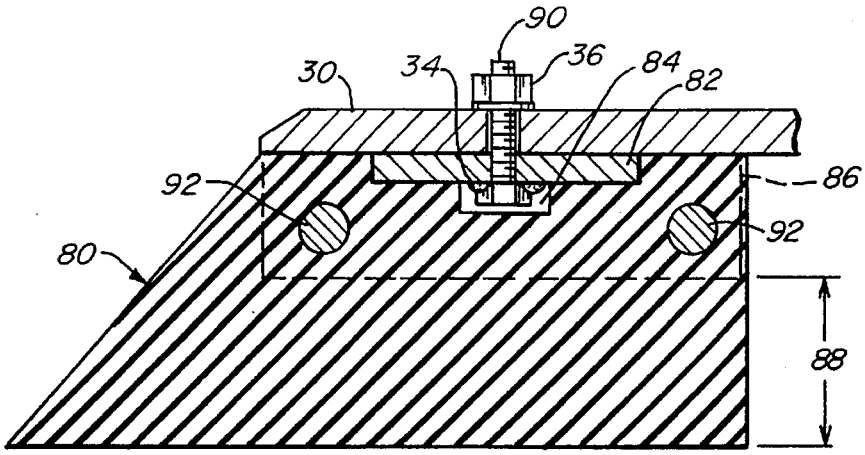
Figure 9:
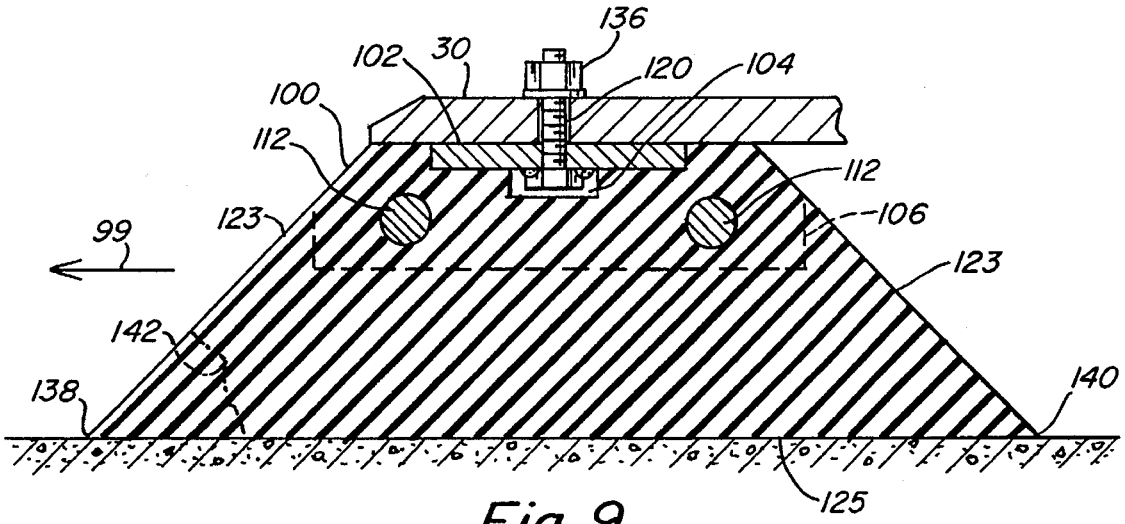
Figure 10:
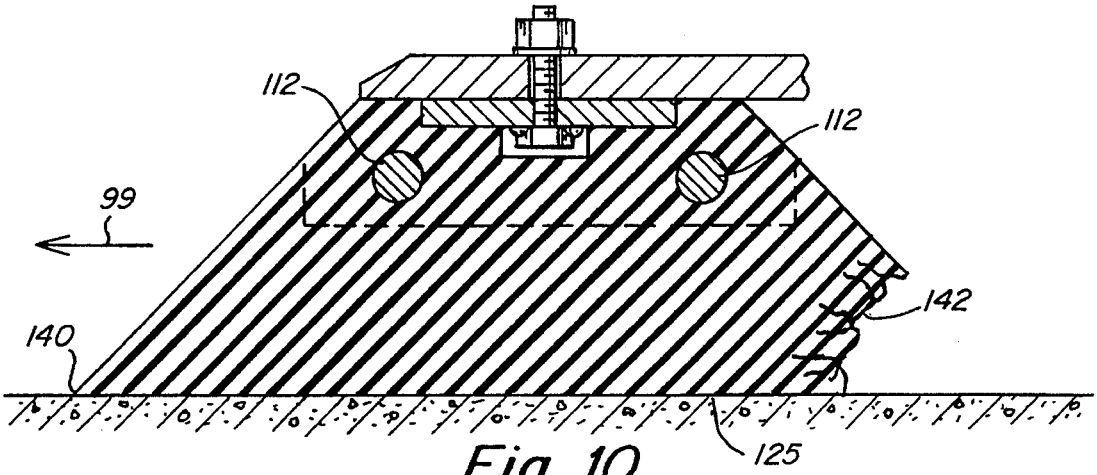
Figure 11:
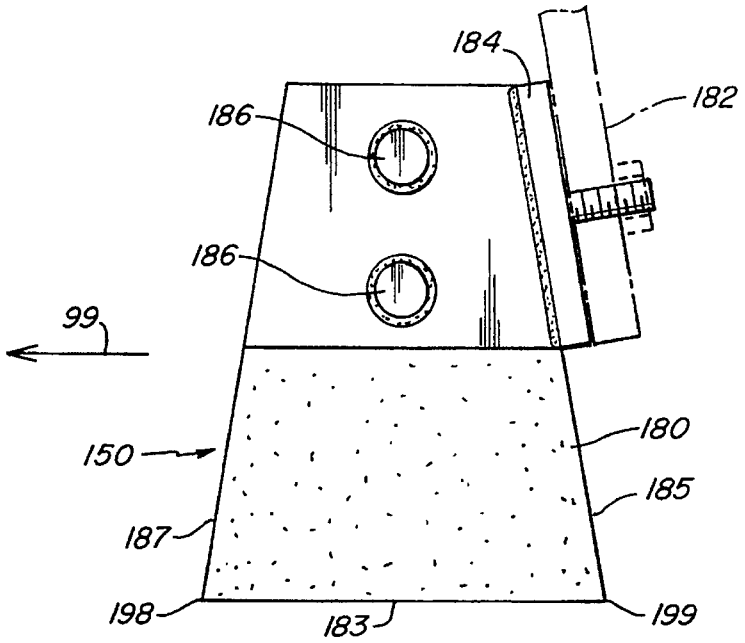
Figure 12:
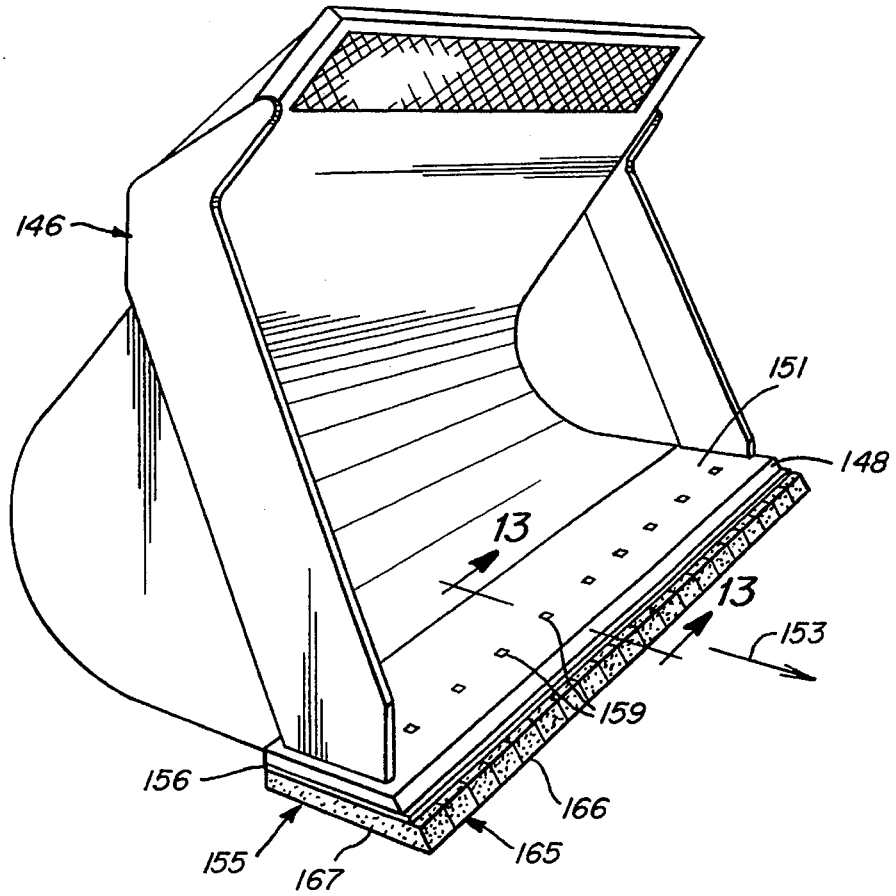
Figure 13:
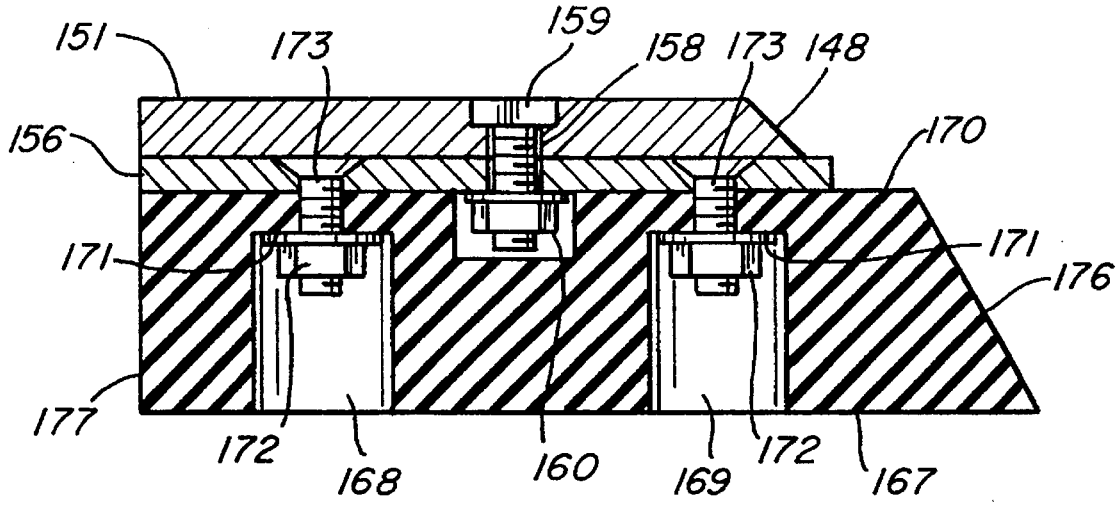

FIG.: 4 is a cross-section taken along the line 4—4 in FIG. 3;

FIG. 5 is a cross-section taken along the line 5—5 of FIG. 2;

FIG. 6 is an end view of a plow with a wear pad according to a second embodiment of the present invention;

FIG. 7 is an alternative embodiment of the cross-section taken along the line 4—4 in FIG. 3;

FIG. 8 is still another embodiment of the cross-section taken essentially along a line equivalent to line 4—4 in FIG. 3;

FIG. 9 is still another embodiment of the cross-section taken essentially along a line equivalent to line 4—4 in FIG. 3;

FIG. 10 is the embodiment illustrated in FIG. 9 with the wear pad reversed after use;

FIG. 11 is still another embodiment of the cross-section taken along a line substantially equivalent to the type of line identified in FIG. 3;

FIG. 12 is a perspective view of a typical material-handling bucket, to which is attached a modification of the present invention; and FIG. 13 is a cross-sectional, enlarged detail, taken substantially along the line 13—13 of FIG. 12.

DETAILED DESCRIPTION

Figure 1:
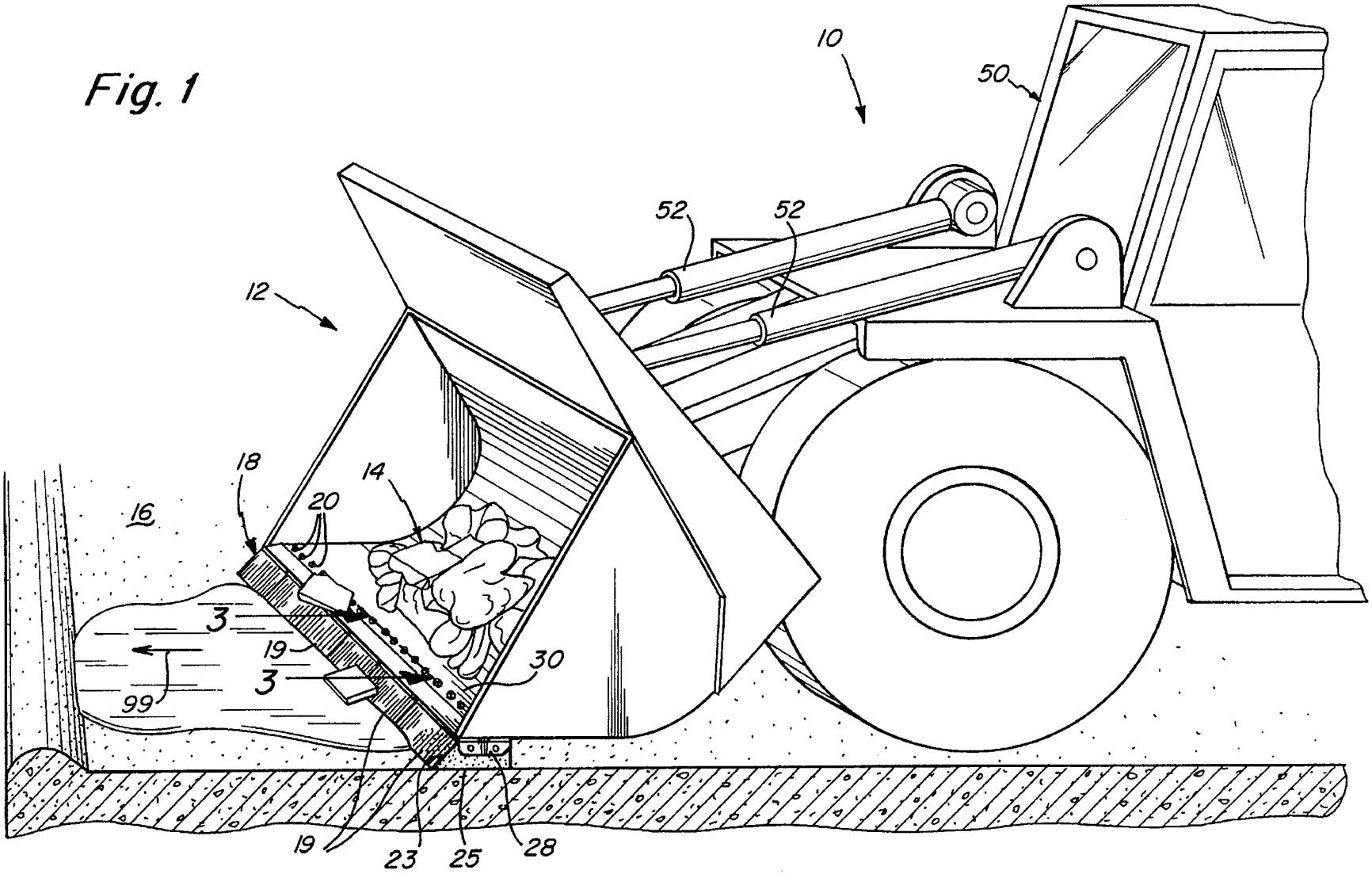
FIG. 1 is a pictorial view of a front end loader with a wear pad assembly according to the present invention.

Referring to FIG. 1, a front end loader 10 has a bucket 12 for picking up or pushing objects 14 from a ground surface 16, such as a floor or street. The bucket, which is typically made of metal, is controlled by an operator (not shown) in a cab 50. The operator moves levers which control hydraulic pistons 52 which move the bucket.

A wear pad assembly 18 has a number of wear pads 19 which are coupled to a bottom surface of the bucket with bolts 20. The wear pad assembly has a flat bottom surface 25 and a parallel top surface. The top surface abuts the bottom portion of the bucket and preferably extends along the entire width of the bucket, and is transverse to a direction of operation (indicated by arrow 99).

Referring to FIG. 2, each wear pad 19 has a number of similar sections 22. The characteristics of the wear pads are important features of this invention. The wear pads must be made of a material which will lessen the abrasion of the floor. This may be achieved by using material which is resilient and/or more susceptible to abrasion than the floor. Preferably, rubber or possibly some forms of plastic may satisfy such requirements. The most satisfactory material for these and other reasons within the scope of this invention are treads from radial truck tires or from earth moving vehicles. Thus the sections are made of a material which is durable enough not to wear quickly on a concrete surface, while not doing damage to a concrete surface, such as treads of rubber tires or from some other fabric reinforced rubber. Nylon or rayon or some other fabric is preferably used as a reinforcing material. Steel-belted tires may be used, but they are less desirable because they may cause damage to a concrete surface.

When fabric reinforced tires are used, the fabric is along one side of each section. The fabric is typically from about 6 ply up to about 30 ply for tires on large earth moving vehicles. Since the durometer of the fabric is about 20–30, and is about 40–80 for the rubber in the tires, it may be preferable to use tire treads which have fewer layers of fabric. For example, truck tires have less fabric than tires for earth moving vehicles.

Sections 22 are sandwiched together and compressed along an axis transverse to the direction of operation. The sections each have a substantially flat, inclined front surface 23 which is at an acute angle relative to the bottom surface, thus helping to scoop up material 14.

Sections 22 abut a steel top plate 24 which is substantially coextensive in surface area with the combined top surfaces of the plurality of sections. At the ends of each wear pad 19, a steel end plate 28 is welded perpendicular to top plate 24. These end plates 28 each have two apertures. Metal rods 26 extend through openings in each of the rubber sections 22 and are mounted in the apertures in the end plates.

Figure 4:
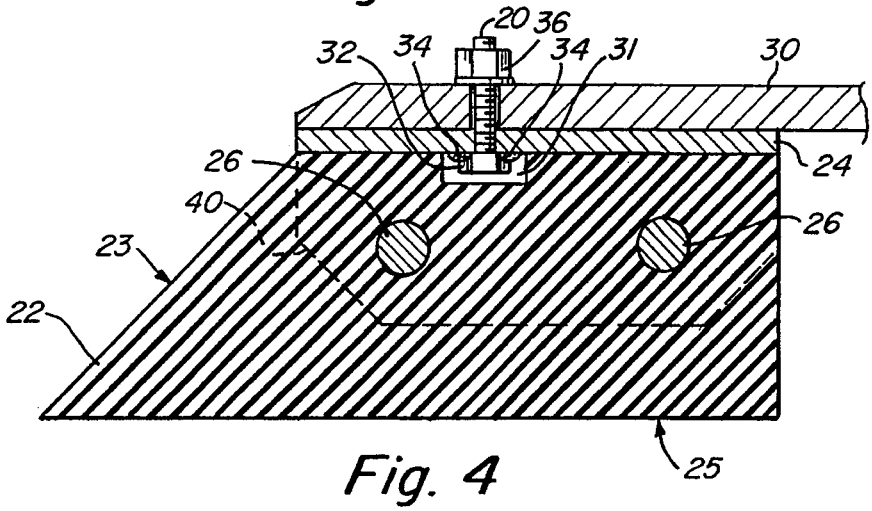

Referring to FIGS. 3 and 4, in one embodiment, top plate 24 is coupled to bottom portion 30 of the bucket with bolts 20 and nuts 36. Each bolt 20 has a head 32 which is under top plate 24 in a grooved channel 31 in the sections, and is coupled to top plate 24 with welds 34. At the top of bottom portion 30 of the bucket, nuts 36 are tightened on the bolts to connect the wear pad to the bucket.

Between some of the rubber sections 22, a plurality of steel dividers 40 are perpendicularly welded to top plate 24. The dividers may be positioned periodically, e.g., one for every three sections. When the pad is assembled, the sections and a divider are compressed before the divider is welded. Consequently, the sections adjacent the dividers have a flared portion at the bottom. Thus, when two wear pads 19 are coupled to a bucket, the bottom surface provides more complete coverage on the ground surface, even though there may be a little space between the sections at the top plates due to the end plates of each wear pad and due to a gap between the wear pads. The welded dividers help to maintain the compressing force and thus also to provide additional stability to the row of sandwiched rubber pieces.

Referring to FIGS. 4 and 5, rods 26 extended longtitudinally through section 22 and dividers 40 to support the sections . Metal rod 26 extends through openings in sections 22 and support pieces 40. Rod 26 is welded to plate 28 and to support pieces 40.

A wear pad is assembled by first obtaining a top plate and drilling bolt holes. The size of the bolt holes can vary depending on a manufacturer's specification for the bucket or plow. The bolts are inserted in the bolt holes and the heads of the bolts are welded to the top plate. An end plate is welded perpendicular to the end of the top plate and the rods are connected to the end plate. A number of sections are placed over the rods and are stacked against the end plate. A divider is positioned on the sections, the divider and the sections are compressed, such as with a hydraulic press, and the divider is welded to the top plate. Sufficient compression is used to squeeze the sections together in a very tight abutting relation so that one section is fixed relative to its adjacent sections. This process is repeated until the other end of the top plate is reached, and the other end plate is welded to the top plate.

In a representative embodiment, each section is generally trapezoidal, having a rear height of six inches, a top width of eleven inches, a bottom width of seventeen inches, and a thickness of about two inches. The back surface is preferably perpendicular to the top and bottom surfaces. At the front surface, the pad is inclined at an angle of about 45° to the ground to assist in picking up or pushing objects or material. The holes for supporting the metal rods are 1.25 inches each in diameter, and are 6 inches apart. At the top of sections 22, a 0.75 inch deep groove is cut 5.5 inches from the back surface of the rubber sections. Steel support plate 24 is about 0.5 inches thick, eleven inches wide, and has a length which is determined by the width of the bucket and the number of wear pads to be employed. The dividers are preferably spaced about four to six inches apart. There are preferably two to six wear pads in a wear pad assembly, for a typical total length of about six to thirteen feet, depending on the bucket or plow size. When assembled, a wear pad can weigh 75 pounds per foot.

The dimensions described above may be varied depending on needs and on the size of the wear pad assembly is coupled. Referring to FIG. 6, for example, when coupling a bucket, plow, or other device to which the wear pad assembly 150 to a plow 152, it can be desirable to have a front surface 54 of the wear pad assembly at about the same angle as the bottom section 56 of the plow. The angle may be different for a plow because a plow pushes material, whereas a bucket picks up material. Another possibility is to use fewer, thicker sections rather than the two inch thick sections which are typically used currently.

For some types of debris or material, it may be desirable to have the metal bucket strike the material first. Referring to FIG. 7, in another embodiment, a wear pad 60 has a front surface 64 which is at an obtuse angle 66 relative to the bottom surface 65. The end plate 62, shown here in phantom, is modified compared to the embodiment of FIG. 4. Otherwise, this embodiment is similar to that shown in FIG. 4. By using a wear pad with an obtuse angle relative to the ground, the metal bucket can strike the material if desired. The wear pad still prevents the bucket from striking the ground, and reduces the impact on the ground when the bucket is lowered quickly, and does not fold under the bucket or plow when in operation.

Referring to FIG. 8, in another embodiment of the present invention, a top plate 82 is recessed with a first channel in section 80. A second smaller channel 84 is provided as in the embodiment of FIG. 4 for forming a space for the head of a bolt. A steel end plate 86 (in phantom) may be varied to accommodate this arrangement. In one embodiment of the wear pad according to FIG. 8, the total height of the section is about five inches and the height of the wear, represented by arrows 88, is about three inches. This embodiment has a similar wear height to the wear pad described in connection with FIG. 4, but uses less material in each section and less steel in top plate 82 since it is narrower than top plate 24 (FIG. 4). As a result, the wear pad according to FIG. 8 may be about one-third lighter than a similarly sized wear pad according to the embodiment of FIG. 4. Bucket 30, steel rods 92, bolt 90, nut 36, and weld 34 are each similar to the corresponding elements in the embodiment of FIG. 4, or can be easily adapted.

As illustrated in FIG. 9, the wear pad is intended to move in the direction of arrow 99 when supported on a typical plow. The wear pad may, for example, have a general construction similar to the wear pad illustrated in FIG. 8. In this arrangement, the top plate 102 is recessed within a first channel in section 100. A second smaller channel 104 is formed as in the embodiment of FIG. 4 and FIG. 8 for purposes of forming a space for the head of a bolt. A steel end plate 106 shown in phantom is positioned on either end of the parallel arranged plurality of sections 100. Sections 100 may be varied in number as previously described and are locked together under compression by the pair of plates 106 at either end which are secured together by a pair of metal rods 112. The rods 112 are suitably locked to the end plates 106 by suitable lock washers and nuts. The plate 102 is suitably locked to a bottom portion 30 of the bucket by a series of aligned bolts 120 and nuts 136 in a manner similar to the corresponding bolts described in connection with FIGS. 3 and 4. As described to this point, the construction illustrated in FIG. 9 may be generally similar to that shown in FIGS. 3 and 4. In the embodiment of FIGS. 9 and 10, however, the surfaces 123 of each section of the wear pad are arranged symmetrically at acute angles to the bottom surface 125 thus forming edges 138 and 140 with the lead edge 138 as illustrated in FIG. 9. In the course of using this wear pad, the lead edge normally wears and abrades over a reasonable time period. Thus, as illustrated by the dotted line 142, the lead edge may ultimately abrade and no longer function as well as the wear pad did when new. Accordingly, the pad may be reversed so that the edge 140 now assumes the lead position in movement of the wear pad in the direction of arrow 99 with the worn edge 142 trailing also, as illustrated in FIG. 10.

The reversal of the wear pad may be simplified by providing rods 112 which may be removed from the unit without cutting the rod. To this end the rods would normally be locked in position using conventional bolts at one or both ends and tightened to compress the plurality of adjacent sections 100 together.

The embodiment illustrated in FIG. 11 is similar in general construction and purpose to that illustrated in FIGS. 9 and 10. In this arrangement, the wear pad assembly generally illustrated at 180 is designed to move in the direction of arrow 99 when secured to a bucket or other apparatus 182 by suitable means such as a frame 184 having suitable end walls as illustrated secured together by a pair of tie rods 186. The tie rods 186 may be threaded at the ends and secured by bolts on the outer side of the pair of parallel plates or walls 184 with a plurality of wear pad sections 180 sandwiched between them. The plurality of wear pad sections 180 are die cut from tires as previously described with a pair of holes in the die cut sections through which the rods 186 extend. The individual wear pad sections are formed with a bottom surface 183 and acutely angularly formed side surfaces 185 and 187 that extend angularly from the bottom surface 183. The surfaces 185 and 187 are preferably symmetrically arranged in a manner similar to the embodiment shown in FIGS. 9 and 10. The wear blade assembly illustrated in FIG. 11 is used in substantially the same fashion as that described in the earlier embodiments. When the wear pad section 180 wears on one edge, the wear pad sections may be reversed so that the edges 198 and 199 may be reversed.

The wear pad may be made from molded pieces of rubber, synthetic rubber, reinforced rubber, or from some other reinforced material such as a plastic which has strength and does not wear easily. In this embodiment, illustrated in FIGS. 12 and 13, the device 146 to which the apparatus is secured is a bucket of conventional design. Other apparatus may also be used. This bucket has a bottom portion 151 having a ground-surface-engaging edge 148, which normally is moved in a first direction, as illustrated by the arrow 153, when the apparatus is used to push or pick up material from the ground surface. The apparatus generally illustrated at 155 includes a common support 156 in the form of an elongated metal plate that extends the length of the bottom portion 151. This elongated plate is provided with means for connecting the plate 156 to the bottom portion 151 of the apparatus 146. These means comprise a series of bolt holes 158 in plate 156, through which bolts 159 extend and are secured appropriately by nuts 160. The plate 156 should extend the length of the bottom portion 151 and typically may be four to five feet in length. The plate is preferably about 10 inches wide, with a thickness of about ¾". The bolt holes 158 preferably have a square recess, so that the nuts of the bolt heads may be secured against possible rotation.

A longitudinal array of wear pads 165 is secured below and to the plate 156. These wear pads have bottom surfaces arranged in a parallel, longitudinally extending array, with one edge 166 of the bottom surfaces 167 forward of the edge 148 of the bottom portion 151 in direction 153.

Means are provided for commonly supporting this array of wear pads, with the bottom surfaces of each wear pad aligned to contact the ground surface forward of the engaging edge 148. This common support for the wear pads comprises means for connecting the individual wear pads to the common support plate 156. These means comprise a pair of holes 168 and 169 in each wear pad extending from the bottom surface 167 to the top surface 170 of the wear pad. Each of these holes, 168 and 169, has an offset or shoulder section 171, which provides a shoulder that engages a nut 172 that is threaded onto a bolt 173. Each wear pad is formed with a pair of aligned openings so that two bolts secure each wear pad to the common plate 151.

As illustrated in FIG. 12, these plates are arranged in a longitudinal array, side by side, individually secured to the common plate 156, in turn secured to the bottom portion 151. The individual wear pads are provided with a forward beveled surface 176 and a rear surface 177 orthogonal to the bottom surface 167. The forward surface 176 provides an angular pushing surface. This angular pushing surface tends to lift trash, or other material being lifted, into the bucket 146.

On occasion of wear, the individual wear pads may be substituted one for the other.

In the preferred form, the individual wear pads should have uniform dimensions. However, in some embodiments, certain of the wear pads may be of different dimensions. For example, in one embodiment, the end wear pads may be narrower than the wear pads between the end units. Typically, a wear pad, as illustrated in FIG. 13, may be 16" in length and 6" in width, with a height of 4½". The holes 168 and 169 may have a diameter of in the order of 2½", with the offset smaller section in the order of 13/16". These holes may be centered in each wear pad, seven inches apart, with the rearmost hole 3½" from the end wall 177. The wear pads, in a preferred embodiment, may be molded of suitable rubber, with or without reinforcing material, depending upon the wearability or abrasion resistance desired.

In use, the wear pads may arranged as illustrated in FIG. 12 or reversed, if a flat edge is desired, so that the end 177 is forward. Additionally, individual wear pads may be readily removed by unbolting the bolts 173 and substituting one or more of the wear pads.

Some devices may not necessarily have a linearly transverse bottom portion, but may be angled or curved, particularly when the device is a plow. In this case, the axis along which the sections are sandwiched may be a curve or may have different portions, as in the case of a V-shaped front. When a plow or other device is operated at an angle relative to the travel direction of a pushing truck, the wear pad is still considered transverse the direction of operation.

According to the present invention, the wear pad assembly is tough enough to withstand abrasion from rough floor surfaces, impact with large objects that are moved or pushed, and the large downward forces from the bucket driving the wear pad into the ground surface.

Having described the embodiment of the present invention, it should become apparent to those skilled in the art that other modifications can be made which do not depart from the scope of the appended claims.

What is claimed is:

1. A wear pad apparatus for use with a large machine operated device which is used to pick up or push material from a surface and is operated in a first direction, the wear pad apparatus to be coupled to the device, the wear pad apparatus comprising:

a plurality of similar abradable sections sandwiched in a nonrotational manner along an axis which is transverse to the first direction, the plurality of abradable sections forming a wear pad having a pair of edges which may be selectively arranged whereby either edge may function as a lead edge in the first direction; and a frame for securing the plurality of abradable sections together and to the device.

2. The wear pad apparatus of claim 1, wherein the similar abradable sections are each formed with a top surface, a bottom surface and symmetrically arranged side surfaces extending at an acute angle from the bottom surface toward the top surface to define the pair of edges.

3. The wear pad apparatus of claim 2, wherein the frame includes means tBr locking each abradable section in fixed relation to an adjacent abradable section.

4. The wear pad apparatus of claim 2, wherein each abradable section has at least one aperture and the frame includes at least one rod extending through the at least one aperture of each abradable section.

5. The wear pad apparatus of claim 4, wherein the at least one aperture includes a pair of apertures and the at least one rod includes a pair of rods extending through the pair of apertures.

6. The wear pad apparatus of claim 2 wherein the plurality of abradable sections comprises pieces of fabric reinforced rubber tires.

7. The wear pad apparatus of claim 2, wherein each of the abradable sections has a quadrilateral shape.

8. The wear pad apparatus of claim 7, wherein each of the abradable sections is trapezoidal.

9. The wear pad apparatus of claim 1, wherein each abradable section has a thickness which is parallel to the ground and perpendicular to the first direction, and a width which is parallel to the first direction, wherein the width is greater than the thickness.

10. The wear pad apparatus of claim 9, wherein each abradable section comprises rubber which is reinforced with a fabric.

11. The wear pad apparatus of claim 9, wherein the wear pad has a top surface and the frame comprises a top plate which abuts the bottom portion of the device and abuts the top surface of the wear pad.

12. The wear pad apparatus of claim 1, wherein the wear pad has a top surface and the frame includes a top plate which abuts the bottom portion of the device and abuts the top surface of the wear pad.

13. The wear pad apparatus of claim 12, wherein the frame further includes a pair of end plates, each end plate being disposed on opposite ends of the top plate and arranged to extend away from the bottom portion, the abradable sections being compressed between the end plates.

14. An apparatus for use with a large machine operated metal device for picking up or pushing objects on a ground surface in a first direction, the device having a bottom portion with a ground surface engaging edge to which the apparatus is to be coupled, the apparatus comprising:

an abradable wear pad assembly including, a plurality of like wear pads arranged in a parallel longitudinally extending array, each of the plurality of wear pads having a bottom surface adapted to engage the ground surface and an outer mounting surface; and an elongated plate constructed and arranged to commonly support the plurality of wear pads to the bottom portion of the device with the bottom surfaces aligned to contact the ground surface forward of the engaging edge, each of the plurality of wear pads being individually connected to the elongated plate with the outer mounting surface abutting the elongated plate.

15. The apparatus of claim 14, wherein the elongated plate includes means for connecting each wear pad to the plate.

16. The apparatus of claim 15, wherein the means for connecting each wear pad to the elongated plate comprises a plurality of bolts extending downwardly into each wear pad and secured thereto by nuts.

17. The apparatus of claim 14, wherein at least one of the plurality of wear pads has a quadrilateral cross section with a top surface that is the outer mounting surface.

18. The apparatus of claim 14, wherein at least one of the plurality of wear pads comprises a rubber material.

19. A wear pad apparatus for use with a large machine operated device which is used to pick up or push material from a ground surface and is operated in a first direction, the device including a bottom portion with a ground engaging edge, the wear pad apparatus comprising:

a plurality of wear pad modules constructed and arranged to be coupled along the bottom portion of the device adjacent the ground engaging edge, each of the plurality of wear pad modules including, a frame, having an underside, that is to be independently coupled beneath the bottom portion; and a wear pad including a plurality of abradable sections coupled to the underside of the frame along an axis that is transverse to the first direction, the wear pad having a bottom surface and an edge defined by the plurality of sections, the bottom surface being adapted to engage the ground surface and the edge being arranged as a lead edge in the first direction when the wear pad module is coupled to the bottom portion.

20. The wear pad apparatus of claim 19, wherein at least one of the plurality of wear pad modules includes a wear pad having a pair of edges, either of which can be arranged to be the lead edge.

* * * * *